US005907883A

United States Patent [19]

Thomasson

[11] Patent Number: 5,907,883

[45] Date of Patent: Jun. 1, 1999

[54] WRINGING METHOD AND WRINGING MECHANISM FOR FLOOR MOP

[76] Inventor: Stig Ola Thomasson, Vardavägen F 325, S-224 71 Lund, Sweden

[21] Appl. No.: 08/971,001

[22] Filed: Nov. 14, 1997

Related U.S. Application Data

[63] Continuation-in-part of application No. 08/795,607, Feb. 5, 1997, Pat. No. 5,722,105.

[51] Int. Cl.[6] ..... A47L 13/142

[52] U.S. Cl. ..... 15/120.2; 15/120.1; 34/388

[58] Field of Search ..... 15/116.1, 119.1, 15/120.1, 120.2; 34/388, 398

[56] References Cited

U.S. PATENT DOCUMENTS

| | | | |
|---|---|---|---|
| 1,255,804 | 2/1918 | Shipherd | 15/120.2 |
| 1,710,190 | 4/1929 | Regan | 15/120.2 |
| 1,861,795 | 6/1932 | Hertzberg | 15/121 |
| 1,870,845 | 8/1932 | Goldfinger | 15/120.2 |
| 2,042,892 | 6/1936 | Granger | 15/120.2 |
| 2,066,096 | 12/1936 | Currie | 15/120.2 |
| 2,230,101 | 1/1941 | Bakemeier | 15/120.2 |
| 2,365,437 | 12/1944 | Schaefer | 15/120.2 |
| 2,495,846 | 1/1950 | Johnson | 15/120.2 |
| 2,677,838 | 5/1954 | Jouban | 15/120.2 |
| 4,135,274 | 1/1979 | Freeman | 15/244.1 |

FOREIGN PATENT DOCUMENTS

| | | |
|---|---|---|
| 568977 | 4/1924 | France . |
| 570511 | 5/1924 | France . |
| 582968 | 1/1925 | France . |
| 456321 | 4/1950 | Italy . |
| 472531 | 7/1953 | Italy . |
| 110249 | 6/1925 | Switzerland . |
| WO 91/19450 | 12/1991 | WIPO . |

OTHER PUBLICATIONS

Expressen, Feb. 12, 1995.

*Primary Examiner*—Mark Spisich

*Attorney, Agent, or Firm*—Fasth Law Offices; Rolf Fasth

[57] ABSTRACT

A floor mop having a stick 10, a mop head 11 including a mop fabric 12 and a lower handle 13 and an upper handle 19. The lower handle is axially and rotatably movable relative to the stick 10 and is attached to one end of the mop fabric 12 of the mop head. The other end of the mop fabric is non-rotatably attached to a lower end of the stick 10. The upper handle 19 is attached to the stick 10 or to an attachment member 16 that is mounted on the stick 10 to enable the rotation of the stick relative to the lower handle 13 to wring the mop fabric 12 of the mop head.

31 Claims, 2 Drawing Sheets

FIG. 1
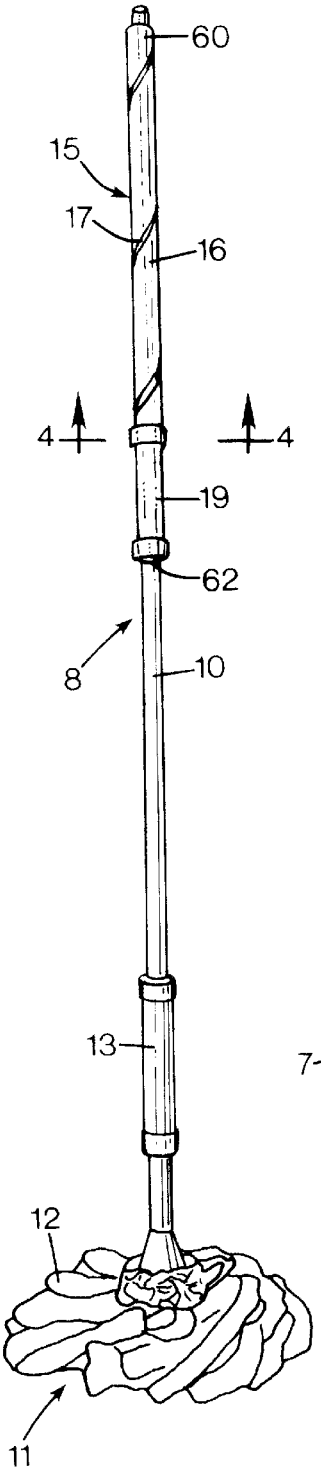
FIG. 2
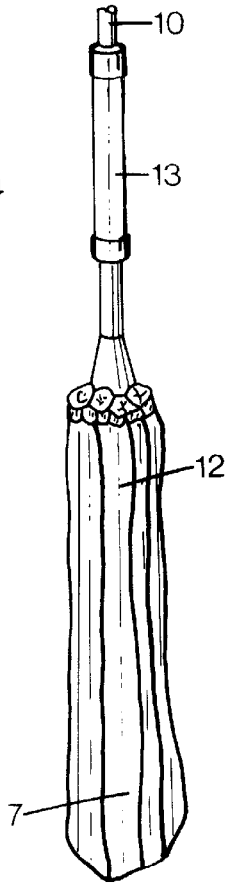
FIG. 3
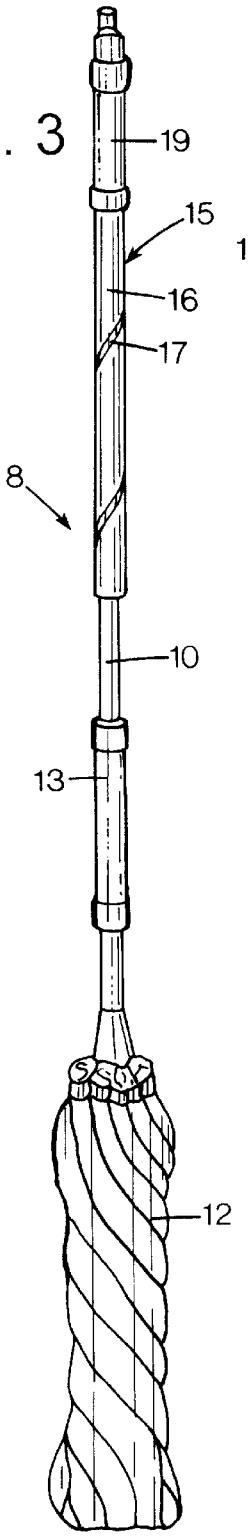
FIG. 4
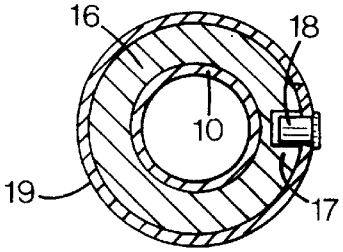
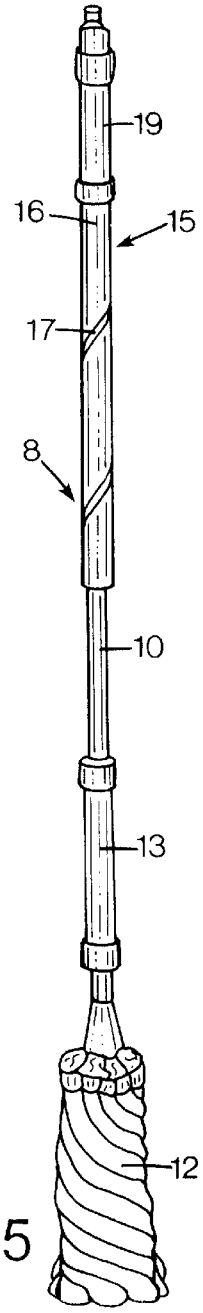
FIG. 5

WRINGING METHOD AND WRINGING MECHANISM FOR FLOOR MOP

PRIOR APPLICATION

This is continuation-in-part application of patent application Ser. No. 08/795,607; filed Feb. 5, 1997, U.S. Pat. No. 5,722,105.

TECHNICAL FIELD

The present invention relates to a floor mop, a novel wringer mechanism, and a wringing method therefor.

BACKGROUND INFORMATION AND SUMMARY OF THE INVENTION

The present invention relates to an improved floor mop. The prior art mops include a stick; a mop head having mop fabric; and a lower handle. The lower handle is axially and rotatably movable relative to the stick and is attached to one end of the mop fabric of the mop head. The other end of the mop fabric is non-rotatably secured to a lower end of the stick. The mops further include an upper handle that is attached to the stick so that the upper handle is rotatable relative to the lower handle to wring the mop fabric of the mop head. This type of floor mop is commonly referred to as a twister mop and is sold in large quantities under the SMARTMOP and other trademarks and is very successful. When employing this mop during cleaning, the lower handle is lowered so that the mop fabric of the mop head has a rosette shaped appearance. When the mop head is later cleaned, the mop head is immersed into a liquid or into rinsing water. To wring the liquid out of the mop, the mop fabric of the mop head is stretched by moving the lower handle upwardly so that the mop fabric is substantially parallel to the stick. The lower handle is then rotated about the stick so that the lower handle and the upper handle are rotated in opposite directions. The result is that the mop fabric is pressed against the stick during rotation so that the mop fabric is tightly twisted and extends in a helical path about the stick. The rinsing and wringing procedure can then be repeated if it is necessary or desirable.

These prior art floor mops have the drawback of being difficult to wring, particularly for those who have weak hand strength. Additionally, the method of wringing the mop is cumbersome and time consuming and the procedure is divided into steps requiring changes of the grip requiring a high level of coordination. When the grip is shifted from one grip to another it is difficult to maintain the partial wringing of the mop that has already been accomplished.

Another problem of other prior art mops described in the patent literature is that the twisting of the mop fabric of the mops is often initiated before the strips are stretched which reduces the affect of the wringing operation.

One objective of the present invention is thus to improve the prior art floor mops described above and commonly referred to as twister mops.

The floor mop of the present invention includes a stick, a mop head of mop fabric and a lower and an upper handle. The lower handle is axially and rotatably movable relative to the stick and is attached to one end of the mop fabric of the mop head. The other end of the mop fabric is non-rotatably secured to the lower end of the stick. The upper handle is in operative engagement with at least one helical groove defined in the mop stick. This helical groove is either defined directly in the mop stick, or in an attachment member such as a sleeve or an extension that is attached to an upper portion of the stick. The helical groove defined in the mop stick or in the attachment thereto enables a rotation of the stick relative to the lower handle by longitudinally moving the upper handle in the helical grooves to wring the mop fabric of the mop head. In particular, the upper handle has a protrusion that is adapted to engage the helical groove to rotate the mop stick, by axially moving the handle away from the mop fabric which prior to the wringing has been pulled up around and is substantially parallel to the mop stick. In other words, the helical groove converts a translational movement of the upper handle along the stick to a rotational movement by the stick.

In a preferred embodiment of the floor mop of the present invention, an upward translational movement of the upper handle is used when the mop fabric is to be wrung. This novel method of upward movement of a shiftable handle has been shown to be far superior with regards to both easy handling and effective wringing compared to the prior art wringing methods.

The grooves of the present invention are not necessarily defined in the mop stick itself. This has many notable advantages. For example, an attachment member may be mounted to existing mops of the customary type available and is independent from the configuration of the mops with regard to the mop head and the attachment of the mop head to the rest of the mop as long as the basic principles of the function of the mop are according to the mops described above. A significant hygienic and functional advantage is the position of the wringing mechanism because the rinsing water never comes in contact with the mechanism.

In one embodiment of the floor mop of the present invention, the wringing mechanism includes an attachment member and a protrusion extending radially inwardly from the upper handle to operatively engage the helical groove of the attachment member so that the stick may be rotated by upwardly shifting the upper handle along the attachment member. If the present invention is provided as an wringing accessory to the earlier described prior art mop, this accessory includes the upper handle, an attachment member and the protrusion extending therefrom so that the protrusion is in operative engagement with the helical groove of the attachment member.

When it is desirable to wring the mop, the lower handle is moved upwardly so that the mop fabric of the mop head is stretched and aligned parallel to the stick. The upper handle is then shifted away from the lower handle so that the stick and the lower end of the mop fabric are rotated as the upper handle is moved upwardly in the helical groove. In this way, the stick is rotated relative to the mop fabric of the mop head that is attached to the lower handle. The result is an automatic wringing when both handles are moved away from one another. More water is wrung out of the mop fabric by continuing the pull on the upper handle when it stops in its uppermost position due to the restraint of the mop fabric. This continued pull results in the lower handle moving downward, so that the ends of the mop fabric are pressed together, providing a very effective final squeeze of the mop fabric.

BRIEF DESCRIPTION OF THE DRAWINGS

FIG. 1 is a perspective view of an embodiment of the mop of the present invention wherein the mop is in an operational mode;

FIG. 2 is a perspective view of a portion of the same mop wherein the mop fabric is in an extended position;

FIG. 3 is a perspective view of the mop wherein the mop fabric is twisted about the stick;

FIG. 4 is a cross sectional view along line 4—4 of FIG. 1;

FIG. 5 is a perspective view of the mop wherein the mop fabric is both twisted about the stick and longitudinally compressed;

DETAILED DESCRIPTION OF PREFERRED EMBODIMENTS

Figure 6:
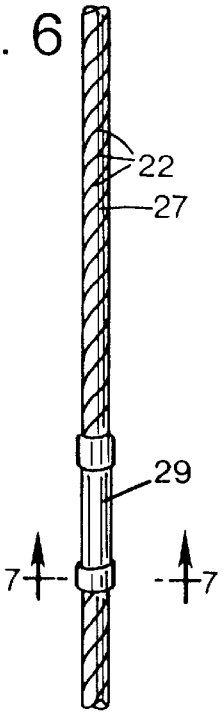
FIG. 6 is a perspective view of an alternative embodiment of the present invention

With reference to FIGS. 1–5 the floor mop 8 of the present invention includes an elongate stick 10. A mop head 11 is attached to a lower end of the stick 10. A highly absorbent mop fabric 12 has one end 7 attached to the lower end of the stick 10 and the other end is attached to a sleeve or handle 13. An upper end of the stick 10 may have an attachment member 16 attached thereto. However, it is to be understood that it is not necessary to include the attachment member 16 in the present invention, as explained in detail below.

The groove of the attachment member 16 may also be defined on an extension that is longitudinally added to the length of the stick 10, or it may be defined on the mop stick itself. The handle 13 is freely shiftable along and rotatable about the stick 10. In a prior art mop, an upper handle may be rigidly secured to the stick 10 at a distance of about 35 centimeters from an upper end of the stick. According to the preferred embodiment of the present invention, this handle has been replaced with an upper handle 19 that is adapted to be in operative engagement with a helical groove 17 or such defined directly in the mop stick or in the elongate attachment member or sleeve 16 that is secured to the mop stick 10 that is described in detail below.

In a preferred embodiment of the present invention, the attachment member 16 or the mop stick itself has the helical groove 17 defined therein that extends from an upper portion 60 to a lower portion 62 of the attachment member 16 or on the mop stick correspondingly. An important feature of the attachment member 16 together with the upper handle 19 in operative engagement therewith is that they may be adapted to be mounted to a conventional twister mop stick (such as the SmartMop mop stick) as an accessory. The attachment member 16 should in this case be made sufficiently long so that the lower portion 62 of the attachment member covers the screw holes for mounting the prior art upper handle so that the holes may be used to attach the attachment member 16. The attachment member 16 may be made of a wide variety of materials including a plastic material that is suitable for conventional plastic forming processes. For example, a low friction plastic may be used to form the attachment member 16 to make it easy to slide the handle 19 on the attachment member 16. This is one of the many advantages of having the groove defined in the attachment member, as opposed to directly in the mop stick itself. It is often not practical to mold the whole mop stick out of plastic. By using an attachment member that is mounted on the mop stick it is possible to select a material that is optimal for the wringing mechanism without having to take other considerations into account. A relatively thick attachment member improves the mechanical strength of the attachment member 16. Another advantage of defining the helical groove or grooves in the attachment member (as opposed to defining the grooves directly in the stick itself) is that the diameter of the attachment member 16 may be adjusted without having to make the whole stick of a thicker diameter. A thick stick is not only more expensive to make but also heavier.

Additionally, if the helical groove of the attachment member is damaged, it is only necessary to replace the attachment member and not the whole stick. Although it is in many respects advantageous to define the helical groove in the attachment member, the present invention is not limited to this embodiment. The helical groove may be defined directly in or on the upper end of the stick 10 also, which in turn has its own advantages. The details of the helical groove may be varied. For example, it may have a wave-shaped bottom and it may take the embodiment of a ridge or it may be a series of holes, cavities or elevations. If the helical groove is to be defined directly on the mop stick itself, it is possible to make holes along a helical outline, and, for example, let a cam follower take the shape of a cog wheel. It is also possible to manufacture the mop stick with a ridge or a series of elevations along a helical outline, either in one piece or by attaching the ridge or elevations to the mop stick.

A protrusion 18 (see FIG. 4) is disposed on an inside of the upper handle 19 so that the protrusion is in operative engagement with the helical groove 17 defined on an outside surface of the attachment member 16 or the mop stick 10 and so that the stick 10 is rotatable when the upper handle 19 is axially or longitudinally shifted along the helical groove.

Figure 8:
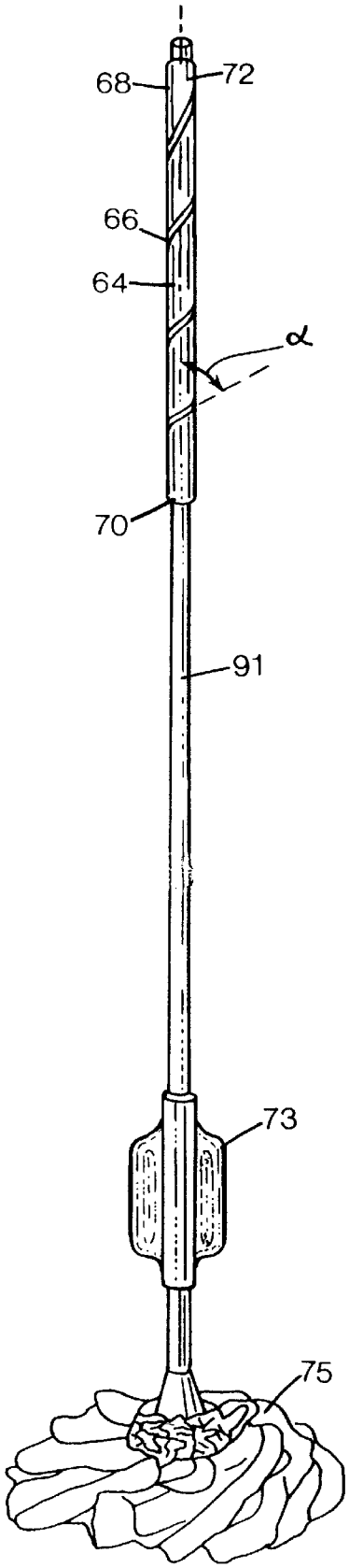
FIG. 8 is a perspective view of an alternative embodiment of the present invention showing a helical groove with a gradually increasing slope.

The slope of the helical groove may preferably vary along its length. As best seen in FIG. 8, an attachment member 64 has a helical groove 66 defined therein. The attachment member 64 has an upper portion 68 and a lower portion 70. The slope has an angle alpha at the lower portion 70 that is approximately 45 degrees relative to the longitudinal axis of the attachment member 64. It is to be understood that the angle alpha may be more or less than 45 degrees. The angle of the helical groove 66 may be gradually reduced as the helical groove extends from the lower portion 70 to the upper portion 68. The mop fabric provides a somewhat increasing resistance as the upper handle is moved axially upwardly to wring the mop fabric. The gradual reduction of the angle of the slope of the helical groove reduces the effort required to wring the mop fabric. When the handle reaches an upper end segment 72 that is substantially parallel with the longitudinal axis of the stick, it stops due to the restraint of the twisted-up mop fabric, (or due to the fact that it has reached the end of the helical groove). The continued pull on the upper handle 19 causes the lower handle to approach the bottom end of the mop stick. This causes the ends of the twisted-up mop fabric to be pressed together. This may be regarded as a second phase of the wringing, caused by the one single motion of pulling the upper handle 19 upwards. For reasons of clarity, this second wringing/squeezing phase is hereinafter often described as the user pushing a lower handle 73 toward a mop fabric 75 while the upper handle is held in its uppermost position, to further wring out water from the mop fabric 75, as best seen in FIG. 5. But, it must be stressed that the great merit of the new method/invention herein described, is that the user experiences that he is carrying out only one single upward motion of a handle, resulting in a very effective wringing of the mop fabric in two phases. The first phase is the twisting of the mop fabric around the mop stick. The second phase is the pushing together of the ends of the twisted-up mop fabric. This two-in-one effect is one of the major advantages of the present invention.

In an alternative embodiment, the helical groove may be a helical ridge that extends along the mop stick itself or along the attachment member and protrudes radially outwardly. If a helical ridge is used, then the upper handle may have either a relatively short conventional straight groove or a short helical groove defined therein to operatively engage the helical ridge. Variations with rollers etc. are also possible. The mop may include a locking mechanism on the upper handle so that the handle may be temporarily locked in a desired position along the mop stick.

When using the mop of the present invention for cleaning, the various components are preferably positioned as is shown in FIG. 1. However, it is not necessary for the upper handle 19 to be in its lower position because the handle may also be disposed in an upper position along helical groove by means of a locking device. When the mop is to be wrung, the upper handle 19 is usually in its lower position. If this is not the case, the handle is moved to its lower position (see FIG. 1), The lower handle 13 is then lifted so that the mop fabric of the mop head is extended along the stick (see FIG. 2). The upper handle 19 is moved upwardly, engaging the helical groove and turning the mop stick until the mop fabric is fully twisted (or until the uppermost end of the helical groove is reached, as best seen in FIG. 3). The continued pull on the halted upper handle 19 at this point causes the ends of the mop fabric to be pushed together, squeezing more water from the fabric and resulting in an excellent wringing result, as best seen in FIG. 5.

An effective method for rinsing the mop is to immerse the mop head into water, after which the upper handle is gripped and moved from its lower position to its upper position. Then the mop head and the mop fabric are rotated and spread out by this upward movement of the handle 19. This rotation facilitates the rinsing and removal of dirt from the mop fabric. After the handle 19 is allowed to fall to its lower position, the lower handle 13 is pulled upwardly in order to stretch the mop fabric. The next step is to push the handle 19 upwardly in the direction away from the handle 13. This results in a wringing that can be regarded as being divided into two phases. As a first result, the stick 10 and the lower end of the mop head are rotated relative to the lower handle 13 and thus relative to the upper end of the mop head. The mop fabric is thereby twisted into a spiral shape about the stick 10 and the strips of the mop fabric are wrung in this first wringing phase (see FIG. 3). The continued pull on the upper handle 19 after it has stopped in its path along the helical groove then automatically and quite effortlessly results in a second phase wringing where the ends of the mop fabric are pressed together, yielding a highly effective wringing result (see FIG. 5). Because the wringing is accomplished by the protrusion 18 and the helical grooves 17 so that the protrusion 18 is guided in the helical groove 17 in the manner described above and not through a manual twisting of the handles 13 and 19 relative to one another requiring several changes of the grip with high coordination (as is required in twister mops such as the mop sold under the SMARTMOP trademark etc.), it is much easier and quicker to achieve good wringing results. A twister mop wrung by the method and device herein described is therefor far more practical and easy to use than the prior art twister mops. To remove some more drops of water from the mop fabric, the lower handle 13 may be pressed further against the mop fabric while the upper handle 19 is held in its tight uppermost position.

As is apparent from the above description, the present invention is a substantial improvement over the prior art mops. The present invention may be provided as a completely new and fully equipped floor mop including the wringing mechanism or as a separate wringing accessory that is adapted to be mounted on the prior art mops of the type represented by the mop that is sold under the SMARTMOP trademark and similar mops.

The figures only show examples of embodiments of the present invention. Another possible alternative embodiment of the present invention is to switch the position of the helical groove 17 and the protrusion 18, that is having the helical groove 17 defined on the inside of the attachment member shaped portion of the handle 19 (which in that case must be extended) and the protrusion 18 attached directly to the stick 10. To achieve the full effect of the invention, it is thus required that the stick 10 and the handle 19 are attached to one another with the assistance of a helical groove and a protrusion. Other modifications are obviously possible within the scope of the invention.

According to the above described embodiments a helical groove and the protrusion have been employed to convert the translational movements to rotational movements. If desired, other mechanisms may be used to accomplish this conversion even though mechanisms based on at least one helical groove and a protrusion are often the easiest and the least expensive.

It is also possible to design the mop stick or the attachment member 16 so that it has a shape that is not round. For example, the attachment member or the mop stick may have a polygon shaped cross section that is in operative engagement with the handle in such a way that the shifting of the handle in the axial direction also causes the stick to rotate.

Figure 7:
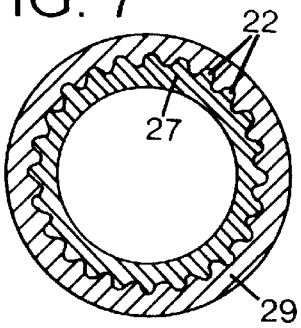
FIG. 7 is a cross sectional view along line 7—7 of FIG. 6.

An alternative embodiment of the above cross section of the stick 10 or an attachment member attached to the stick is shown in FIGS. 6 and 7. In the illustrated embodiment, at least one land portion 22 is formed on a component 27 such as an attachment member mounted on the stick, or on the stick itself. Additionally, a handle 29 includes at least one cam follower or land portion defined on the inside of the handle to operatively engage and cooperate with the land portion 22. The slope of the helical grooves preferably varies along the length of the wringing mechanism. In general, this alternative embodiment functions in the same way as the earlier described embodiment, as shown in FIGS. 1–5.

The protrusion may take many embodiments, without departing from the spirit of this invention. It may be an immovable and integrated extension of the upper handle, or a rolling ball, or a rolling peg or a wheel, with or without cogs, depending on the embodiment of the helical groove. Or, if the groove itself is elevated as a ridge, the protrusion is adapted thereto, taking the form of a cavity of some sort, as discussed in a previous passage herein.

While the present invention has been described with reference to preferred embodiments, it is to be understood that certain substitutions and alterations may be made thereto without departing from the spirit and scope of the invention as set forth in the appended claims.

I claim:

1. A method of wringing a floor mop, the method comprising the steps of:

providing a floor mop comprising a stick and a mop head including a mop fabric having one end attached to the stick;

providing a lower handle in operative engagement with the stick and the mop fabric;

providing an attachment member having a helical groove defined therein, the attachment member being attached to the stick;

providing an upper handle in operative engagement with the helical groove;

shifting the lower handle upwardly and away from the mop head and stretching the mop fabric along the stick;

shifting the upper handle upwardly in the helical groove to rotate the attachment member and the stick; and wringing the mop fabric.

2. The method of wringing according to claim 1 wherein the step of providing an upper handle comprises the step of providing the upper handle with an inwardly protruding extension and the step of shifting the upper handle comprises the step of permitting the inwardly protruding extension to be guided by the helical groove.

3. The method of wringing according to claim 1 wherein the step of providing the attachment member comprises the steps of providing the helical groove with a first slope at an upper end of the attachment member and a second slope at a lower end of the attachment member and the step of shifting the upper handle comprises the step of moving the upper handle upwardly in the second slope and into the first slope.

4. The method of wringing according to claim 1 wherein the step of shifting the upper handle upwardly further comprises the steps of moving the upper handle in an upward direction away from the mop fabric until the mop fabric is fully stretched and wrung about the stick.

5. The method of wringing according to claim 1 wherein the step of shifting the upper handle upwardly further comprises the steps of moving the upper handle away from the mop fabric until the upper handle reaches an end point of the helical groove.

6. The method of wringing according to claim 1 wherein the step of wringing further comprises the step of maintaining the upper handle in an uppermost position and pushing the lower handle away from the upper handle to further wring the mop fabric.

7. The method of wringing according to claim 1 wherein the step of wringing further comprises the step of maintaining the upper handle in an uppermost position and pushing the lower handle towards the mop fabric to further wring the mop fabric.

8. A method of wringing a floor mop, the method comprising the steps of:

providing a floor mop comprising a stick and a mop head including a mop fabric having one and attached to the stick, the stick having a helical groove defined therein;

providing a lower handle in operative engagement with the stick and the mop fabric;

providing an upper handle in operative engagement with the helical groove of the stick;

shifting the lower handle upwardly and away from the mop head and stretching the mop fabric along the stick;

shifting the upper handle upwardly in the helical groove to rotate the stick; and wringing the mop fabric.

9. The method of wringing according to claim 8 wherein the step of providing an upper handle comprises the step of providing the upper handle with an inwardly protruding extension and the step of shifting the upper handle comprises the step of permitting the inwardly protruding extension to be guided by the helical groove.

10. The method of wringing according to claim 9 wherein the step of providing the mop stick comprises the steps of providing the helical groove with a first slope at an upper end of the stick and a second slope at a lower end of the helical groove and the step of shifting the upper handle comprises the step of moving the upper handle upwardly in the second slope and into the first slope, the first slope being different from the second slope.

11. The method of wringing according to claim 8 wherein the step of shifting the upper handle upwardly further comprises the steps of moving the upper handle in an upward direction away from the mop fabric until the mop fabric is fully stretched and wrung about the stick.

12. The method of wringing according to claim 8 wherein the step of shifting the upper handle upwardly further comprises the steps of moving the upper handle away from the mop fabric until the upper handle reaches an and point of the helical groove.

13. The method of wringing according to claim 8 wherein the step of wringing further comprises the step of maintaining the upper handle in an uppermost position and pushing the lower handle towards the mop fabric to further wring the mop fabric.

14. The method of wringing according to claim 8 wherein the step of wringing further comprises the step of maintaining the upper handle in an uppermost position and pushing the lower handle away from the upper handle to further wring the mop fabric.

15. A floor mop comprising:

a stick having a lower end, an opposite upper end and a longitudinal axis extending therebetween;

a mop fabric;

a lower handle disposed at the lower end of the stick, the lower handle being axially and rotatably shiftable relative to the stick, the mop fabric being secured to the lower and of the stick;

an attachment mechanism mounted to the upper end of the stick, the attachment mechanism having a helical groove defined therein and an upper handle rotatably attached to the attachment mechanism and in operative engagement with the helical groove of the attachment mechanism so that an upward longitudinal shifting of the upper handle is converted to rotational movement of the stick to wring the mop fabric.

16. A floor mop according to claim 15 wherein the upper handle has a protrusion adapted to operatively engage the helical groove defined in the attachment mechanism to rotate the stick when the upper handle is upwardly shifted along the longitudinal axis of the stick and the protrusion is guided by the helical groove.

17. A floor mop according to claim 15 wherein the helical groove has a slope that is varied so that the slope has a first slope at an upper portion of the attachment mechanism and a second slope at a lower portion of the attachment mechanism and the first slope is different from the second slope.

18. A floor mop according to claim 17 wherein the helical groove includes an and segment that is substantially parallel with the longitudinal axis of the stick.

19. A method of wringing a floor mop, the method comprising the steps of:

providing a floor mop comprising an elongate stick and a mop fabric having one end attached to the stick;

providing a lower handle in operative engagement with the stick and the mop fabric;

providing an upper handle in operative engagement with the stick;

providing a conversion mechanism in operative engagement with the upper handle, the conversion mechanism being adapted to convert translational movement of the upper handle along the stick to rotational movement of the stick;

shifting the lower handle upwardly towards the upper handle and stretching the mop fabric along the stick;

shifting the upper handle upwardly so that the conversion mechanism rotates the stick; and wringing the mop fabric.

20. The method of wringing according to claim 19 wherein the step of providing the conversion mechanism further comprises providing an attachment member attached to the stick and providing a helical member with a first slope at an upper end of the attachment member and a second slope at a lower end of the attachment member and the step of shifting the upper handle comprises the step of moving the upper handle upwardly in the second slope and into the first slope.

21. The method of wringing according to claim 19 wherein the step of shifting the upper handle upwardly further comprises moving the upper handle in an upward direction away from the mop fabric until the mop fabric is fully stretched and wrung about the stick.

22. The method of wringing according to claim 19 wherein the method further comprises maintaining the upper handle in an uppermost position and pushing the lower handle away from the upper handle to further wring the mop fabric.

23. A method of wringing a floor mop, the method comprising the steps of:

providing a floor mop comprising an elongate stick and a mop fabric having one end attached to the stick, the stick having a protrusion associated therewith;

providing a lower handle in operative engagement with the stick and the mop fabric;

providing an upper handle in operative engagement with the stick, the upper handle having a helical member defined therein;

shifting the lower handle upwardly towards the upper handle and stretching the mop fabric along the stick;

shifting the upper handle upwardly so that the protrusion engages the helical member of the upper handle to rotate the stick; and wringing the mop fabric.

24. The method of wringing according to claim 23 wherein the method further comprises providing an attachment member having said protrusion formed therein attached to the stick and providing the helical member with a first slope at an upper end of the upper handle and a second slope at a lower end of the upper handle.

25. The method of wringing according to claim 23 wherein the step of shifting the upper handle upwardly further comprises moving the upper handle in an upward direction away from the mop fabric until the mop fabric is fully stretched and wrung about the stick.

26. The method of wringing according to claim 23 wherein the method further comprises maintaining the upper handle in an uppermost position and pushing the lower handle away from the upper handle to further wring the mop fabric.

27. A method of wringing a floor mop, the method comprising the steps of:

providing a floor mop comprising a stick and a mop fabric having one end attached to the stick;

providing a lower handle in operative engagement with the stick and the mop fabric;

providing an attachment member having an outwardly projecting protrusion, the attachment member being attached to the stick;

providing an upper handle having a helical member defined therein;

shifting the lower handle upwardly towards the upper handle; and shifting the upper handle upwardly so that the protrusion engages the helical member of the upper handle to rotate the attachment member and the stick relative to the mop fabric.

28. The method of wringing according to claim 27 wherein the step of providing the upper handle comprises the steps of providing the helical member with a first slope at an upper end of the upper handle and a second slope at a lower end of the upper handle.

29. The method of wringing according to claim 27 wherein the step of shifting the upper handle upwardly further comprises moving the upper handle in an upward direction away from the mop fabric until the mop fabric is fully stretched and wrung about the stick.

30. The method of wringing according to claim 27 wherein the method further comprises maintaining the upper handle in an uppermost position and pushing the lower handle away from the upper handle to further wring the mop fabric.

31. The method of wringing according to claim 27 wherein the step of shifting the upper handle further comprises stretching the mop fabric.

* * * * *